US008485080B2

(12) United States Patent
Loibl

(10) Patent No.: US 8,485,080 B2
(45) Date of Patent: Jul. 16, 2013

(54) CUTTING UNIT FOR CUTTING SHEET MATERIAL

(75) Inventor: Bernd Loibl, Klettgau (DE)

(73) Assignee: Monolith GmbH, Schwarze Horn (DE)

( * ) Notice: Subject to any disclaimer, the term of this patent is extended or adjusted under 35 U.S.C. 154(b) by 501 days.

(21) Appl. No.: 12/802,221

(22) Filed: Jun. 2, 2010

(65) Prior Publication Data

US 2011/0138981 A1 Jun. 16, 2011

(30) Foreign Application Priority Data

Dec. 10, 2009 (DE) ..... 20 2009 016 659 U

(51) Int. Cl.
*B26D 1/18* (2006.01)

(52) U.S. Cl.
USPC ..... 83/614; 83/485; 83/613

(58) Field of Classification Search
USPC ..... 83/471.2–471.3, 481, 485, 743, 745–746, 83/469, 483, 523, 455, 613–614, 618, 620, 83/821, 697
See application file for complete search history.

(56) References Cited

U.S. PATENT DOCUMENTS

| | | | | |
|---|---|---|---|---|
| 6,990,884 | B2 * | 1/2006 | Tseng | 83/618 |
| 7,357,057 | B2 * | 4/2008 | Chiang | 83/614 |
| 8,006,597 | B2 * | 8/2011 | Chiang | 83/485 |
| 2005/0028663 | A1 * | 2/2005 | Volfson | 83/651 |
| 2005/0109180 | A1 * | 5/2005 | Schultz et al. | 83/455 |
| 2005/0223863 | A1 * | 10/2005 | Volfson et al. | 83/485 |
| 2006/0053994 | A1 * | 3/2006 | Carrillo et al. | 83/485 |
| 2007/0157783 | A1 * | 7/2007 | Chiang | 83/485 |

FOREIGN PATENT DOCUMENTS

| | | | |
|---|---|---|---|
| DE | 20 2006 000 121 | U1 | 5/2006 |
| DE | 20 2008 011 851 | U1 | 12/2008 |
| EP | 1 533 088 | A2 | 5/2005 |

* cited by examiner

*Primary Examiner* — Phong Nguyen
(74) *Attorney, Agent, or Firm* — Von Rohrscheidt Patents

(57) ABSTRACT

A cutting unit (1) for cutting sheet material (13), the cutting unit comprising a sheet support (2) and at least one roll cutting device (4) associated with a sheet support (2), the roll cutting device comprising a support rail (5), at which a cutting carriage (6) is movably supported, the cutting carriage comprising a blade support (20), which is rotatably supported about an axis parallel to the support rail (5) and rotatable by hand, and at which blade support at least two disk blades (36, 37, 38) are supported freely rotatable about blade axes. The support rail has two support bars (56, 57) and the blade support has at least two support grooves (45, 46, 47). The two support bars engage the two support grooves to lock one of the at least two disk blades in a cutting position.

18 Claims, 4 Drawing Sheets

CUTTING UNIT FOR CUTTING SHEET MATERIAL

RELATED APPLICATIONS

This patent application claims priority from and incorporates by reference German utility model application No. 20 2009 016 659.7, filed on Dec. 10, 2009.

FIELD OF THE INVENTION

The invention relates to a cutting unit for cutting sheet material with a sheet support and at least one roller cutting device associated with the sheet support and including a support rail, on which a cutting carriage is movably supported, the cutting carriage including a blade holder, which is rotatably supported about an axis parallel to the support rail and rotatable by hand, and at which at least two disk blades are supported freely rotatable about blade axes extending perpendicular to the rotation axis of the blade holder, wherein the disk blades can be brought into a cutting position, protruding in a direction towards the sheet support by rotating the blade holder from one respective inactive position, wherein a blocking device is provided, which holds the blade holder in a cutting position for a disk blade.

Manually operated cutting units are being used for cutting sheet material, like sheets of paper and photos for business applications and also for personal applications, the units substantially including a sheet support configured as a base plate, partially or completely receiving the sheet material, and a cutting device, typically disposed at one side of the support plate. For the cutting devices, lever cutting devices and roll cutting devices are known. The latter have a straight support rail extending above the sheet support and in parallel to the sheet support, on which a blade carriage is movably supported. A disk blade is disposed in the blade carriage, so that it is supported rotatable on a substantially horizontal axle, wherein the disk blade is movable from a raised starting position into a lowered cutting position. The cutting process is caused by the blade carriage being moved along the support rail after the disk blade has assumed the cutting position.

Improvements of such cutting units include a roller cutting device, whose blade carriage includes plural, mostly different disk blades, such as a disk blade for straight cutting, a disk blade for serrated cutting and a disk blade for perforations. Such cutting units are disclosed in EP 1 533 088 and DE 20 2008 011 851 U1. The three disk blades are supported freely rotatable on a blade support respectively, which is supported in the blade carriage rotatable about an axis extending transversal to the longitudinal axis of the support rail. Thus, the disk blades are distributed about the circumference of the blade support in angular increments of 120°. The respective desired disk blade can be brought from an inactive position into a downward protruding cutting position through a lateral actuation button. Through pressure from above, the housing of the blade carriage can either be moved downward relative to the stationary mounted support rail, or together with the support rail, and thus the downward protruding cutting blade can be pressed into the sheet material to be cut. Also here, the cutting process is then caused by moving the blade carriage along the support rail.

A cutting device with a similar configuration can be derived from US 2005/0223863 A1. Alternatively thereto, this document discloses a cutting unit, in which four disk blades are supported with their blade axes perpendicular to one another at a blade support, which is supported rotatable about a vertical axis. This arrangement is rather complicated, because the respective blade disk to be brought into cutting position also has to be moved vertically.

DE 20 2006 000 121 U1 discloses a cutting unit of this type, in which the blade support, differently from the art illustrated in FIG. 7 of the instant document, is supported rotatable about an axis extending in parallel to the longitudinal axis of the support rail. The disk blades are supported at the blade support with blade axes freely rotatable, the blade axes disposed in a plane perpendicular to the rotation axis of the blade support, wherein the blade rotation axes, however, do not extend through the rotation axis of the blade support.

In order for the blade support not to be rotatable during the cutting process, a locking device is provided, which supports the blade support in the cutting position. For this purpose, the blade support includes a disk with saw blade teeth, which interacts with a locking catch pivotably supported at the blade carriage, so that the blade support cannot move in a rotation direction, when one of the cutting blades is in cutting position. The cutting force impacting this disk plate during the cutting process is received by the locking catch. Thus, a rotation of the blade support in another direction is not possible due to the particular type of support for the disk blades. Only after completion of the cutting process, the blade support can be rotated in this direction, in order to bring another disk blade into cutting position.

It is disadvantageous for this type of cutting units that the configuration of the blade support and the disk blades supported thereon including the locking device is complex. Furthermore, the configuration of the blade support requires a relatively large free space below the blade carriage, in order to facilitate the rotation of the blade support. Thus, it remains unclear, how the blade carriage with the disk blade disposed in cutting position can be brought in contact with the sheet material to be cut.

BRIEF SUMMARY OF THE INVENTION

It is an object of the invention to configure a cutting unit as recited supra more simply and with a safer support.

This object is accomplished according to the invention in that the locking device is configured as guide elements engaging form locked into one another and configured at the support rail and at the blade support, the locking device retaining the blade support in a rotational angular position with its rotational movement blocked, when one of the cutting blades is disposed in a cutting position, and in that the support rail includes a release range, in which it does not include support elements locking the rotatability of the blade support. Thus, it is the core idea of the invention to lock the blade support with respect to its rotatability through support elements when one of the disk blades is in a cutting position. The support elements provided on one side at the support rail and, on the other side, at the blade support itself, and engage one another in a form locked manner. This way, a simple and safe support configuration is assured.

In an embodiment of the invention, it is provided that the blade axes are disposed in a plane extending perpendicular to the rotation axis of the blade support, so that the blade carriage has a small length. Furthermore, it is provided according to the invention that the disk blades extend in radial direction relative to the rotation axis of the blade support. Based on the support through the support rail, this type of support of the disk blades is possible. This provides installation space for a star shaped arrangement of a plurality of disk blades, for example, nine disk blades.

It is provided in another embodiment of the invention that the support rail includes two disk elements extending adjacent to one another at a distance from one another, and that the disk blade respectively disposed in cutting position reaches through the support rail between the rail elements towards the sheet support. According to this embodiment, the support rail is divided in longitudinal direction into two rail elements extending at a distance from one another. The rail elements include the respective disk blade disposed in cutting position and form an obstacle against unintentional contact with the disk blade, this means the rail elements reduce the risk of an injury through the cutting blade disposed in cutting position to a minimum.

The engagement elements can be configured differently, thus there is the option to configure the engagement elements at least as one pair, comprised of a support groove on side, and a support bar engaging therein, on the other side, wherein eventually it is not significant for the support bar to be formed at the support rail, and thus the support groove being formed at the blade carrier or vice versa.

According to the invention it is furthermore provided that the blade support comprises support elements on both sides of each disk blade, wherein the support elements engage one respective support element at the support rail. In as far as the support rail is divided into rail elements extending adjacent to one another, the support elements on the side of the support rail shall be divided between the two rail elements. Thus, engagement also means the mutual contact of the support elements. This core idea can be implemented, for example, in that the support rail includes two support shoulders oriented in opposite directions and the blade support includes one respective support shoulder on both sides of each disc blade, wherein one respective support shoulder of the support rail contacts one respective support shoulder of the blade support. Thus, advantageously, the support shoulders shall be configured respectively as a mirror image to the cutting blade disposed in cutting position. The measures described supra assure a straight support of the blade holder and thus of the cutting blade disposed in the cutting position.

The support rail can include at least one upward protruding support bar at the support element, which support bar respectively engages a support groove formed in the blade support and comprises, for example, the support shoulders recited supra. The support shoulders complementary thereto can then be formed by the sidewalls of the support grooves.

The release portion provided for changing the disk blade should be configured in a useful manner at an end of the support rail. However, one respective release portion can also be provided at both ends of the support rail. By moving the cutting carriage into the release portion, the support of the blade support is removed at the support rail, which has the consequence that the blade support can be rotated by hand, and thus another disk blade can be brought into cutting position.

In order to assure simple handling, the blade support should protrude at one end of the cutting carriage and should comprise a turning knob, for example, configured as a turning knob, which is knurled on the outside, or a turning knob with a protruding gripping bar.

In another embodiment of the invention, it is proposed that the blade support includes markings that are visible from the outside, which indicate the cutting position of the disk blades. This is particularly useful when the positions of the disk blades are not visible from the outside, because they are disposed protected within the cutting carriage in order to prevent injuries or damages. The cutting carriage shall advantageously comprise a cutout on top for making the marking visible.

According to another feature of the invention, it is provided that a catch device is associated with the blade support, which catches when a cutting position is reached. The catch device provides a reliable feedback to the operator regarding reaching the cutting position.

According to the invention, it is furthermore proposed that the cutting carriage includes a carriage housing with sidewalls, which enclose the support rail on both sides, and the sidewalls are supported at the support rail preferably in the form of a dovetail support.

For lowering the disk blade, which is disposed in the cutting position, onto the sheet material provided for cutting, there are two basic options. The first option is to support the cutting carriage at the support rail, so that the cutting carriage is movable relative to the support rail by introducing a pressure force from above in the direction towards the sheet support, for example, against the effect of an upward oriented spring. In this case, the support rail is rigidly mounted at its ends. Alternatively thereto, it can be provided that the support rail is resiliently supported with its ends at the sheet support. By imparting pressure onto the cutting carriage in the direction towards the sheet support, the cutting carriage and the support rail are then moved downward together. In this case, no vertical movability of the cutting carriage is required with respect to the support rail. Besides that, there is also the option to dispose the support rail so that it is pivotable about an axis that is parallel to the longitudinal axis of the support rail.

According to the invention, it is furthermore proposed that the blade support is divided perpendicular to the orientation of the rotation axis, and the disk blades are supported in the partition plane in recesses in both components of the blade support. This way, the assembly of the blade support and also the support of the disk blades can be simply provided in the blade support.

The blade support itself is advantageously shaped as a drum, which is advantageously insertable into the blade support from below. Otherwise, the disk blades should not be accessible from the side and from the top, thus they should be completely encapsulated, either through the carriage housing of the cutting carriage and/or through the blade support itself. Thus, the cutting blades are protected against unintentional contact by the operator. The cutting unit according to the invention is thus also configured to be operated by children.

BRIEF DESCRIPTION OF THE DRAWINGS

An embodiment of the invention is subsequently described in more detail with reference to drawing figures, wherein.

DETAILED DESCRIPTION OF THE INVENTION

Figure 1:
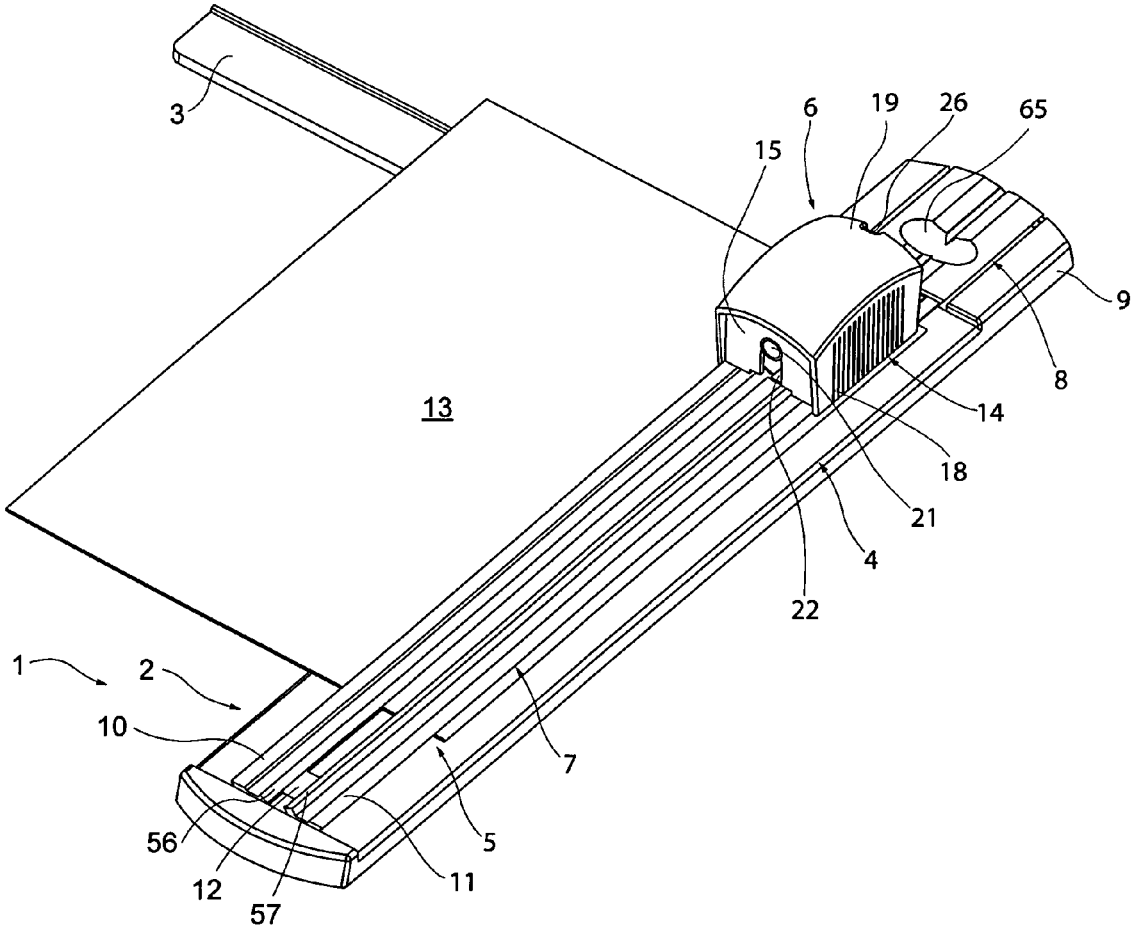
FIG. 1 illustrates the cutting unit according to the invention in a perspective view from above with a paper sheet inserted.

The cutting unit 1 illustrated in the figures includes a short beam shaped sheet support 2, wherein a contact bar 3 is folded out at a right angle from the backside of the sheet support facing away from a viewer. Above and at a distance from the blade support 2, there is a roll cutting device 4, which is substantially comprised of a support rail 5 and a cutting carriage 6, which is movably supported along the support rail 5. The support rail 5 is divided into a first rail component 7 extending above the sheet support 2 with an offset there from, and an adjoining second rail component, which is formed into a head component 9 of the sheet support 2.

The first rail component 7 is supported at both ends at the sheet support 2 through vertical coil springs, which are not illustrated in more detail, so that the first rail component 1 can be moved from the illustrated starting position, in which it has an offset from the upper side of the sheet support 2, into a direction towards the upper side by imparting pressure in this direction. The first rail component 7 is assembled from two rail elements 10, 11 configured parallel and mirror symmetrical to one another, which rail components are disposed at an offset from one another and connected with one another through connection bars provided in the end portions, wherein only the left connection bar 12 is visible herein. A paper sheet 13 is inserted into the intermediary space between the first rail component 7 and the sheet support 2 in order for the paper sheet to be cut.

The cutting carriage 6 has a housing 14, which includes two vertical face walls 15, 16 parallel to one another, which are connected through vertical side walls 17, 18, which are also parallel to one another. The face walls 15, 16 and the side walls 17, 18 are defined on top by a spherically shaped top wall 19.

Figure 2:
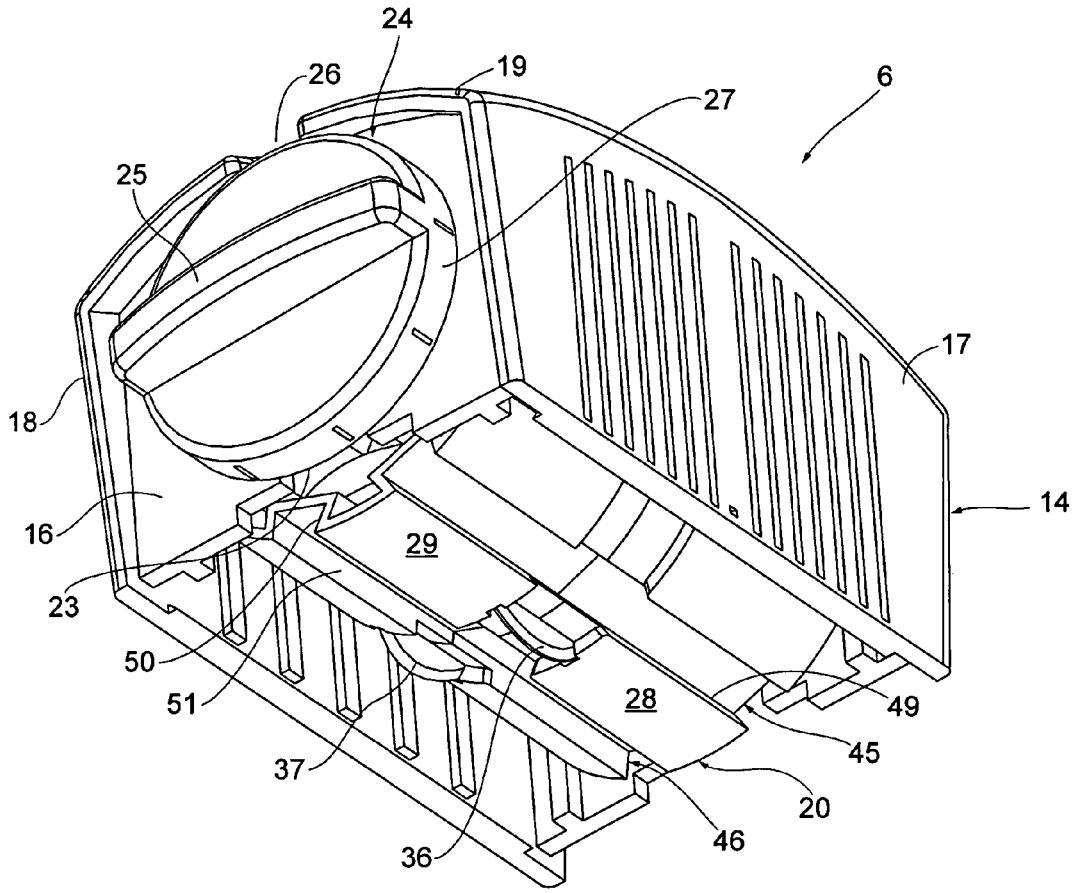
FIG. 2 illustrates the cutting carriage of the cutting unit according to FIG. 1 in a perspective view from below.

A drum shaped blade support 20 is disposed in the housing 14, which terminates in a support pinion 21 in the portion of the face walls 15 visible in FIG. 1, wherein the support pinion is interlocked in a support slot 22, so that the support pinion 21 and thus the blade support 20 itself is rotatably supported about a rotation axis extending parallel to the longitudinal axis of the support rail 5. Another support slot 23 is disposed on the side of the face wall 16 (re. FIG. 2), wherein the blade support 20 is rotatably supported in the support slot through a support protrusion, which is not illustrated in FIG. 2. A turning knob with a grip bar is connected to the support protrusion. The blade support 20 can be rotated about its longitudinal axis through the turning knob 22 from the outside.

The top wall 19 includes a recess 26 in the portion of the turning knob 24, wherein the recess makes a cylindrical section 27 of the turning knob 24 partially visible. There are markings on the cylinder section 27, which indicate the rotation angle position of the blade support 20.

Figure 3:
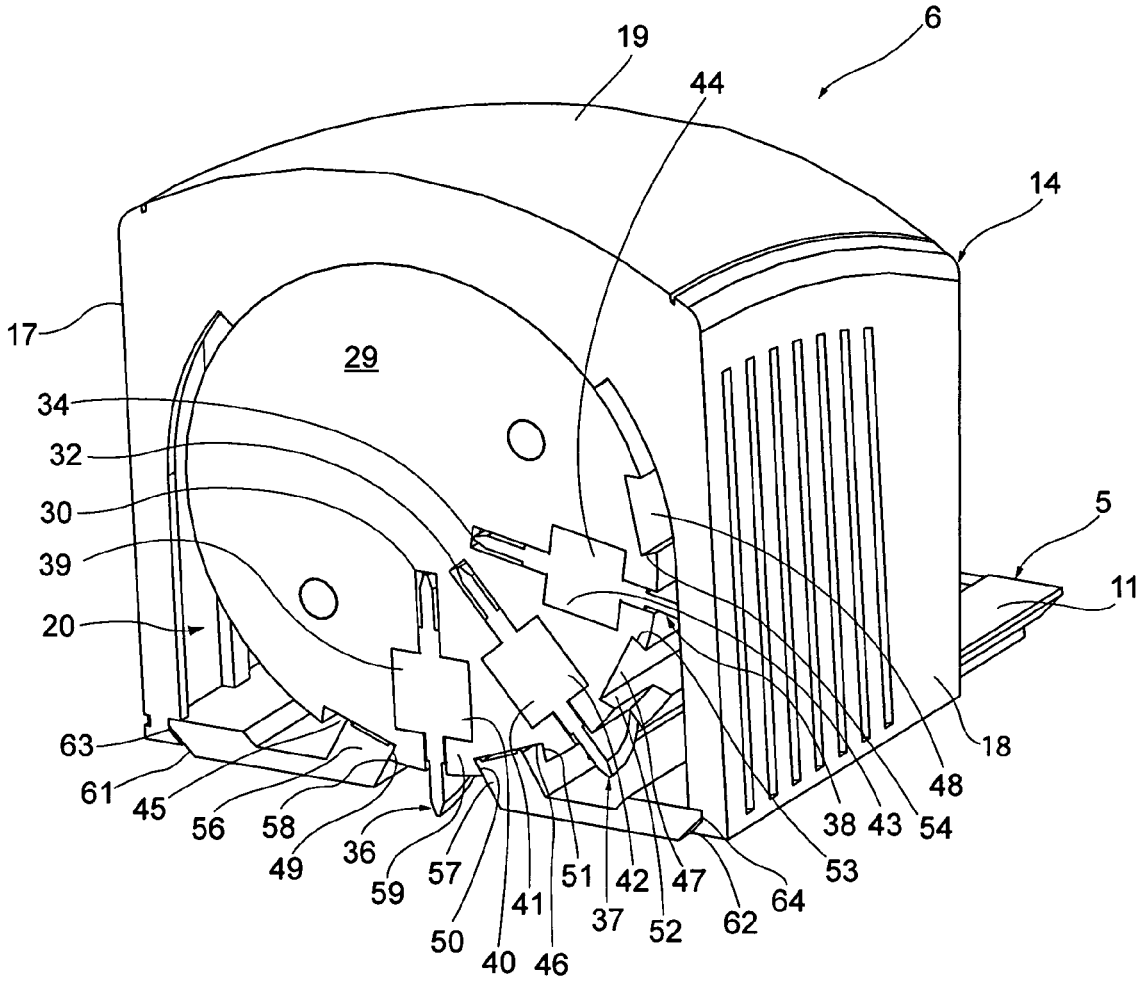
FIG. 3 illustrates a cross sectional view of the cutting carriage according to FIG. 2 and the associated support rail of the cutting unit according to FIG. 1 in a perspective view at a viewing angle towards the right end of the cutting unit in FIG. 1.

The blade support 20 is divided in its longitudinal direction into a first retaining section 28 and a second retaining section 29, wherein the partitioning frame extends perpendicular to the rotation axis of the blade support 20. Both support sections 28, 29 include respective opposite pairs of complementary bearing recesses 30, 31 or 32, 33 or 34, 35, wherein a disk blade 36, 37, 38 (re. in particular the FIGS. 3 and 4) is inserted into each pair of opposite bearing recesses 30 through 35. The disk blades 36, 37, 38 extend radially from the rotation axis of the blade support 20, and include centric support pinions 39, 40 or 41, 42 or 43, 44, through which they are supported freely rotatable in the support recesses 30 through 35. The disk blades 36, 37, 38 protrude radially beyond the circumference of the blade support 20. Thus, the vertically oriented disk blade 36 is in a cutting position, while the other disk blades 37, 38 are in an inactive position.

Four longitudinal grooves 45, 46, 47 extend over the entire length of a jacket of the blade support 20, parallel to its rotation axis, wherein the longitudinal grooves form support shoulders 50, 51 or 52, 53 or 54, 55 adjacent to each disk blade 36, 37, 38. As evident in particular from FIG. 3, support bars 56, 57 engage the longitudinal grooves 45, 46, which are adjacent to the disk blade 36 disposed in cutting position, wherein the support bars extend upward at a slant angle symmetrical to the plane of the disk blade 36 from the first rail component 7 of the support rail 5. The support bars 56, 57 extend over the entire length of the first rail component 7. They are configured, so that they form support shoulders 58, 59 at their opposite sides, which contact the support shoulders 49, 50, which are adjacent to the disk blade 36 disposed in cutting position. This way, the blade support 20 is locket in rotation direction when the first cutting carriage 6 is disposed on the first rail component 7 of the support rail 5.

The outer edges of the support rail 5 include downward oriented slanted portions 61, 62, which are enclosed form locked by the support grooves 63, 64, which are formed into the inner sides of the sidewalls 17, 18. This way, the cutting carriage 6 is movably supported along the support rail 5, and thus in particular as shown in FIG. 4 movably supported into the second rail component 8.

Figure 4:
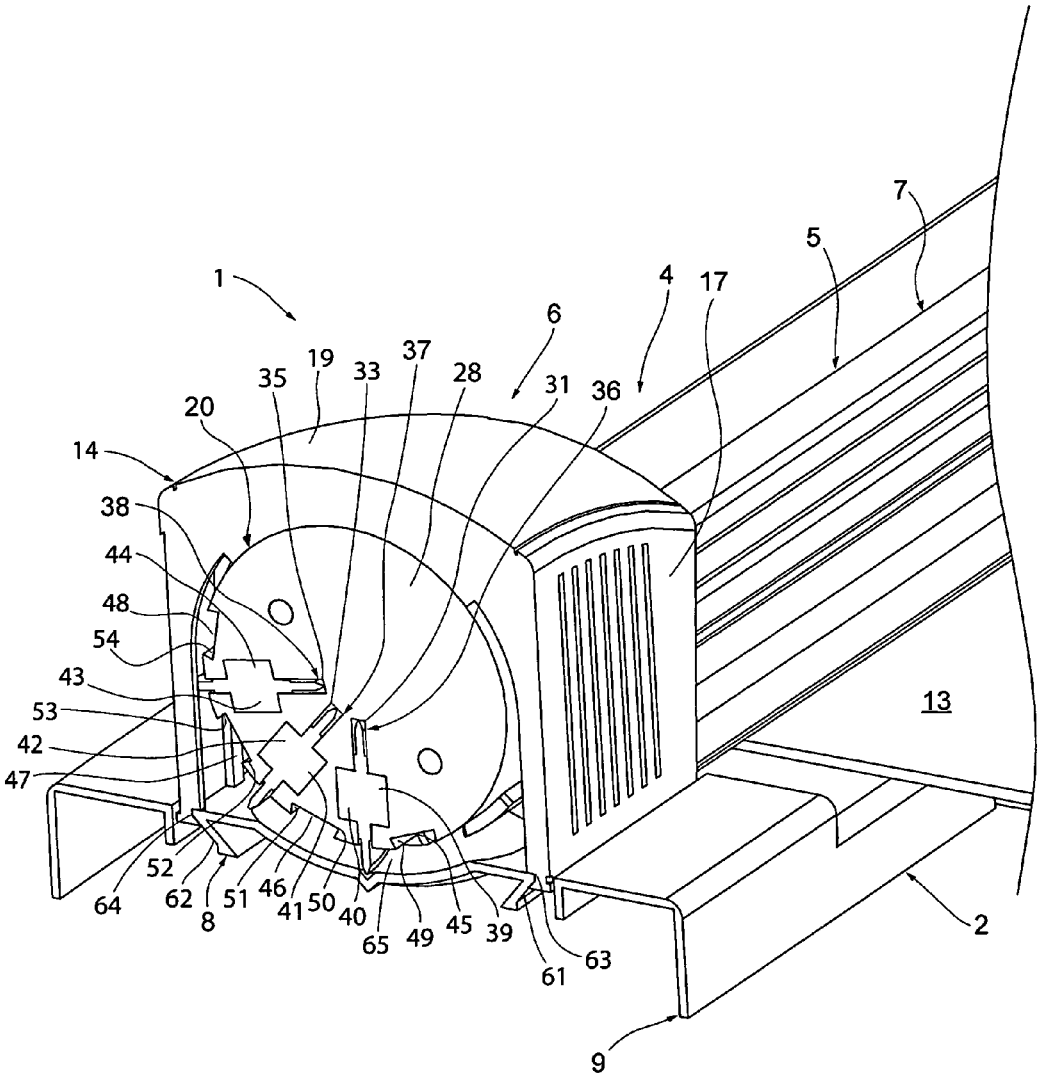
FIG. 4 illustrates a cross sectional view of the cutting carriage according to FIGS. 2 and 3 in the release portion of the support rail at a viewing angle opposite to the viewing angle according to FIG. 3.

In particular, FIG. 4 makes it evident that the second rail component 8 of the support rail 5 does not include support bars 56, 57. A release portion 65 is rather provided there in the center portion, wherein the release portion is lowered far enough, so that the blade support 20 and, thus also the disk blades 36, 37, 38, supported therein, are freely movable, this means the blade support 20 can be rotated counterclockwise in the view according to FIG. 4 in order to bring another disk blade 37 or 38 into the vertical cutting position instead of the disk blade 36. This is performed then through respective handling of the turning knob 24, when the cutting carriage 6 has been moved into the position illustrated in FIG. 4, thus when it is disposed on the second rail component 8 of the support rail 5.

Thus, the disk blades 36, 37, 38 can be configured differently, for example the disk blade 36 is configured for a linear cut, the disk blade 37 is configured for a serrated cut, and the disk blade 38 is configured for a perforation. However, there is also the option to provide disk blades 36, 37, 38, which are configured identically, so that the disk blades 37, 38 are initially provided as spares, should the disk blade 36 become dull.

The cutting process is initiated by moving the cutting carriage 6 from the second rail component 8 into the first rail component 7 and by imparting pressure from above upon the housing 14 in the direction towards the sheet support 2. This lowers the cutting carriage 6 and the support rail 5 against the effect of the coil springs supporting them, so that the disk blade 36 disposed in a cutting position comes in contact with the paper sheet 13. Continuous movement of the cutting carriage 6 over the paper sheet 13 cuts the paper sheet.

What is claimed is:

1. A cutting unit for cutting sheet material comprising:

a sheet support; and at least one roll cutting device associated with the sheet support, the at least one roll cutting device comprising:

a support rail, at which a cutting carriage is movably supported, the cutting carriage comprising a blade support rotatably supported about an axis parallel to the support rail and rotatable by hand, and at which at least two disk blades are supported freely rotatable about blade axes that extend perpendicular to the rotation axis of the blade support, wherein the at least two disk blades are configured to be brought from a respective inactive position into a cutting position protruding in a direction towards the sheet support by rotating the blade support, and wherein a locking device is provided that supports the blade support in a cutting position of a disk blade, wherein the locking device is configured as locking support elements at the support rail and at the blade support, wherein the locking device supports the blade support in a rotational angular position, locking its rotatability when one of the at least two disk blades is in a cutting position, and the support rail includes at least one release portion without any support elements locking the rotatability of the blade support.

2. The cutting unit according to claim 1, wherein the blade axes are disposed in a plane extending perpendicular to the rotation axis of the blade support.

3. The cutting unit according to claim 1, wherein the at least two disk blades extend radially relative to the rotation axis of the blade support.

4. The cutting unit according to claim 1, wherein the support rail includes two rail elements extending next to one another at a distance from one another and a respective disk blade disposed in cutting position reaches through the support rail between the two rail elements in a direction towards the sheet support.

5. The cutting unit according to claim 1, wherein the locking support elements are configured as at least one pair of a support groove on the blade support and a support bar on the support rail.

6. The cutting unit according to claim 1, wherein the blade support comprises the locking support elements on both sides of each disk blade of the at least two disk blades, wherein each locking support element on the blade support engages one respective support element at the support rail.

7. The cutting unit according to claim 6, wherein the locking support elements of the support rail comprise two support shoulders with opposite orientations and locking support elements of the blade support comprise one respective support shoulder on both sides of each disk blade of the at least two disk blades, wherein one respective support shoulder of the support rail contacts a support shoulder of the blade support.

8. The cutting unit according to claim 7, wherein the support shoulders at the support rail are respectively configured as mirror images to a cutting blade disposed in cutting position.

9. The cutting unit according to claim 1, wherein the locking elements of the support rail include at least one upward protruding support bar, wherein the locking support elements of the blade support include at least one support groove, and wherein the at least one upward protruding support bar respectively engages the at least one support groove.

10. The cutting unit according to claim 1, wherein the at least one release portion is configured at one end of the support rail.

11. The cutting unit according to claim 1, wherein the blade support includes a turning knob at one end of the cutting carriage.

12. The cutting unit according to claim 1, wherein the turning knob comprises markings that are visible from outside of the cutting carriage that indicate the cutting position of the at least two disk blades.

13. The cutting unit according to claim 12, wherein the cutting carriage comprises a recess on top of the cutting carriage for making the markings visible.

14. The cutting unit according to claim 1, wherein the cutting carriage comprises a carnage housing with sidewalls that envelop the support rail on both sides and are supported at the support rail through a dovetail support.

15. The cutting unit according to claim 1, wherein the support rail is resiliently supported at its ends at the sheet support.

16. The cutting unit according to claim 1, wherein the at least two disk blades are supported in recesses provided radially in the blade support.

17. The cutting unit according to claim 1, wherein the blade support is drum shaped.

18. The cutting unit according to claim 1, wherein the at least two disk blades are not accessible from above and not accessible from a side.

* * * * *